US009126712B2

(12) United States Patent
Lausted et al.

(10) Patent No.: US 9,126,712 B2
(45) Date of Patent: Sep. 8, 2015

(54) COLLAPSIBLE BOTTLE

(71) Applicant: Ecolab USA Inc., St. Paul, MN (US)

(72) Inventors: Matthew D. Lausted, Hudson, WI (US); Brian P. Carlson, Lakeville, MN (US); Troy A. Anderson, Eagan, MN (US); John T. Pelkey, St. Paul, MN (US); Bryce A. Keilman, Loganville, GA (US); Monis Bangi, McDonough, GA (US)

(73) Assignee: Ecolab USA Inc., Saint Paul, MN (US)

( * ) Notice: Subject to any disclaimer, the term of this patent is extended or adjusted under 35 U.S.C. 154(b) by 12 days.

(21) Appl. No.: 13/826,686

(22) Filed: Mar. 14, 2013

(65) Prior Publication Data

US 2013/0292355 A1 Nov. 7, 2013

Related U.S. Application Data

(60) Provisional application No. 61/642,652, filed on May 4, 2012.

(51) Int. Cl.
*B65D 1/02* (2006.01)

(52) U.S. Cl.
CPC ..... *B65D 1/0292* (2013.01); *B65D 1/0223* (2013.01); *B65D 2501/0036* (2013.01); *B65D 2501/0081* (2013.01)

(58) Field of Classification Search
CPC ..... B65D 1/0292; B65D 1/40; B65D 1/44; B65D 1/0207; B65D 1/02; B65D 1/0223; B65D 3/30; B65D 2501/0036; B65D 2501/0081
USPC ..... 220/672, 673, 670, 675; 215/900, 383, 215/384, 382
See application file for complete search history.

(56) References Cited

U.S. PATENT DOCUMENTS

| | | | | |
|---|---|---|---|---|
| 4,158,376 | A * | 6/1979 | Erb | 383/120 |
| 4,930,644 | A * | 6/1990 | Robbins, III | 215/382 |
| 5,174,458 | A | 12/1992 | Segati | |
| 6,158,620 | A | 12/2000 | Polan | |
| 7,857,156 | B2 | 12/2010 | Inomata | |
| 8,016,162 | B2 * | 9/2011 | Cleary et al. | 222/215 |
| 2007/0272705 | A1 * | 11/2007 | Beine et al. | 222/107 |
| 2009/0114679 | A1 | 5/2009 | Ophardt et al. | |

FOREIGN PATENT DOCUMENTS

| | | |
|---|---|---|
| JP | 2008-56291 | 3/2008 |
| JP | 2009-96511 | 5/2009 |
| JP | 2011-148506 | 8/2011 |

OTHER PUBLICATIONS

International Search Report and Written Opinion for PCT/US2013/031513 mailed Jun. 25, 2013.

* cited by examiner

*Primary Examiner* — Stephen Castellano
(74) *Attorney, Agent, or Firm* — Merchant & Gould P.C.

(57) ABSTRACT

The present disclosure relates to rigid, collapsible bottles that may be drained of their contents by gravity. The structural features of the bottle design help facilitate controlled bottle collapse.

10 Claims, 9 Drawing Sheets

COLLAPSIBLE BOTTLE

CROSS REFERENCE TO RELATED APPLICATIONS

This application claims the benefit of U.S. Provisional Application No. 61/642,652, filed May 4, 2013, entitled "Collapsible Bottle," which is incorporated by reference herein in its entirety.

BACKGROUND

Soaps, cleaning solutions, and other chemicals used in hospital, laboratory, restaurant, and other environments are shipped in and dispensed from bottles, bladders, or other vessels. To access the contents thereof, the vessels may be drained by gravity or dispensed by pumping systems either integral with or discrete from the vessel. Vessels drained by gravity are often more desirable than pumped dispensing system, due to the service and maintenance issues associated with pumps. In general, two types of vessels that drain by gravity are available: open systems and closed systems. In open systems, a volume of contents drained from the vessel is replaced by a substantially equivalent volume of air (much like water dispensing systems that utilize refillable water jugs). In closed systems, a volume of contents drained is not replaced by a substantially equivalent volume of air and the vessel collapses under the vacuum created by the draining action. Closed systems may be desirable to limit the exposure to the contents to the air outside the vessel for quality or other purposes. In a closed system, if the vessel collapses in an uncontrolled manner (otherwise known as a "free collapse"), access to an amount of the contents may be prevented, resulting in wasted product. For example, a bladder may fold over, preventing a portion of the contents from draining. Conversely, if the vessel does not collapse sufficiently, an amount of product may remain in the vessel, again leading to wasted product.

It is against this background that the present disclosure is made.

SUMMARY

The container designs disclosed herein surprisingly have a configuration that allows them to uniformly collapse under a vacuum in a way that allows most of the product contents to be emptied from the container.

Accordingly, in some aspects, the disclosure relates to a collapsible bottle with a unitary molded body having a plurality of panels defining an interior chamber, wherein the plurality of panels include an outlet end panel, a base panel located on a side of the body opposite the outlet, two planar side panels connecting the outlet end panel and the base panel, a planar rear panel connected to each of the outlet end panel, the base panel, and the two planar side panels, a front panel opposite the planar rear panel, wherein the front panel comprises a flat surface and a plurality of curved faceted surfaces connected to the outlet end panel, the base panel, and the two planar side panels, and an outlet integrally formed with the outlet end panel so as to provide access to the interior chamber. In some embodiments, at least one planar side panel or the front panel at least partially defines a slot.

These and other embodiments will be apparent to those skilled in the art and others in view of the following detailed description of some embodiments. It is understood, however, that this summary, and the detailed description illustrate only some examples of the various embodiments, and are not intended to be limiting to the claimed invention.

Figure 1:
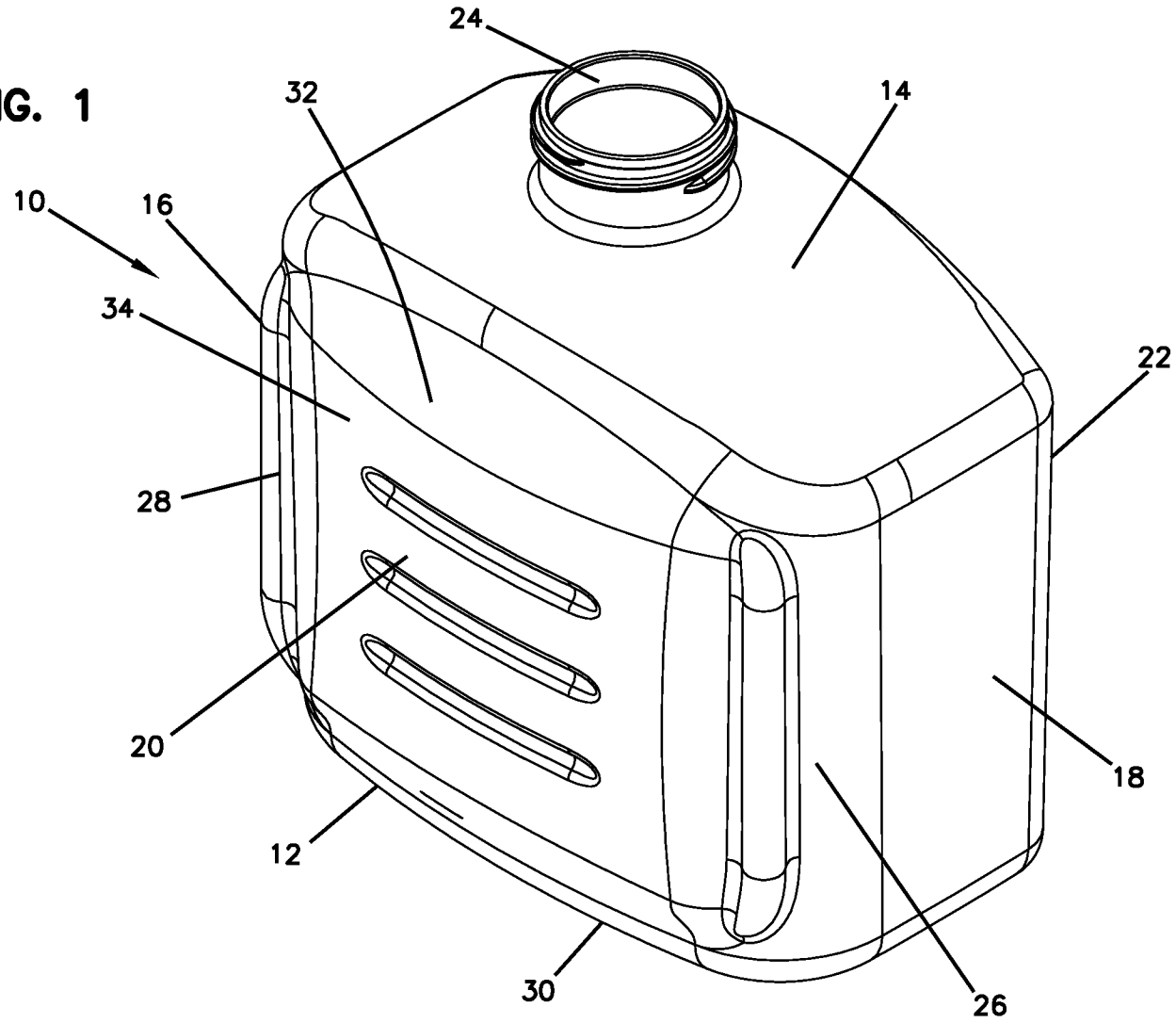
FIG. 1 shows a view of an embodiment the bottle design with slots on the front panel but not on the side panels.

In accordance with common practice, the various described features are not drawn to scale but are drawn to emphasize specific features relevant to the disclosure. Reference characters denote like features throughout the Figures.

DETAILED DESCRIPTION

The present disclosure relates to vessels as collapsible bottles that may be drained of their contents by gravity. Of course, the technologies described herein may also be utilized in bottles that have their contents removed by a pumping mechanism. The technologies described herein allow a significant amount of bottle contents to be removed from a bottle, resulting in a significant reduction in wasted product. In some embodiments, this means that less than 20%, less than 10%, less than 5%, less than 3%, or less than 1% of the original product remains in the bottle once it has completely collapsed.

In particular embodiments, the collapsible bottle is manufactured in a single, unitary piece of molded plastic. Exemplary materials for the bottle include nylon, polyamides, polyvinyl chloride (PVC), polyvinylidene chloride, polystyrene, high impact polystyrene, polycarbonate, bisphenol A, polyethylene terephthalate (PET), high-density polyethylene (HDPE), low-density polyethylene (LDPE), polyester, polyethylene, polypropylene, acrylonitrile butadiene styrene (ABS), polyethylene/acrylonitrile butadiene styrene, polycarbonate/acrylonitrile butadiene styrene, polyurethane, melamine, biodegradable polymers such as polylactic acid-based polymers and corn starch-based polymers, and blends thereof. In some embodiments, the bottle is intended to be rigid, meaning that it holds its shape on its own (for example compared to a flexible bag), but collapse as product is evacuated. Accordingly, the bottle is preferably made out of HDPE or a pliable polymer or polymer blend that provides rigidity but also facilitates bottle collapse. The material can also include additives to improve the properties of the material such as additives that make the bottle stronger or that make the bottle more biodegradable. These additives may be incorporated into the resin itself. In some embodiments, the material preferably allows a portion of or the entire bottle to be reusable, recyclable, biodegradable, or compostable.

Figure 2:
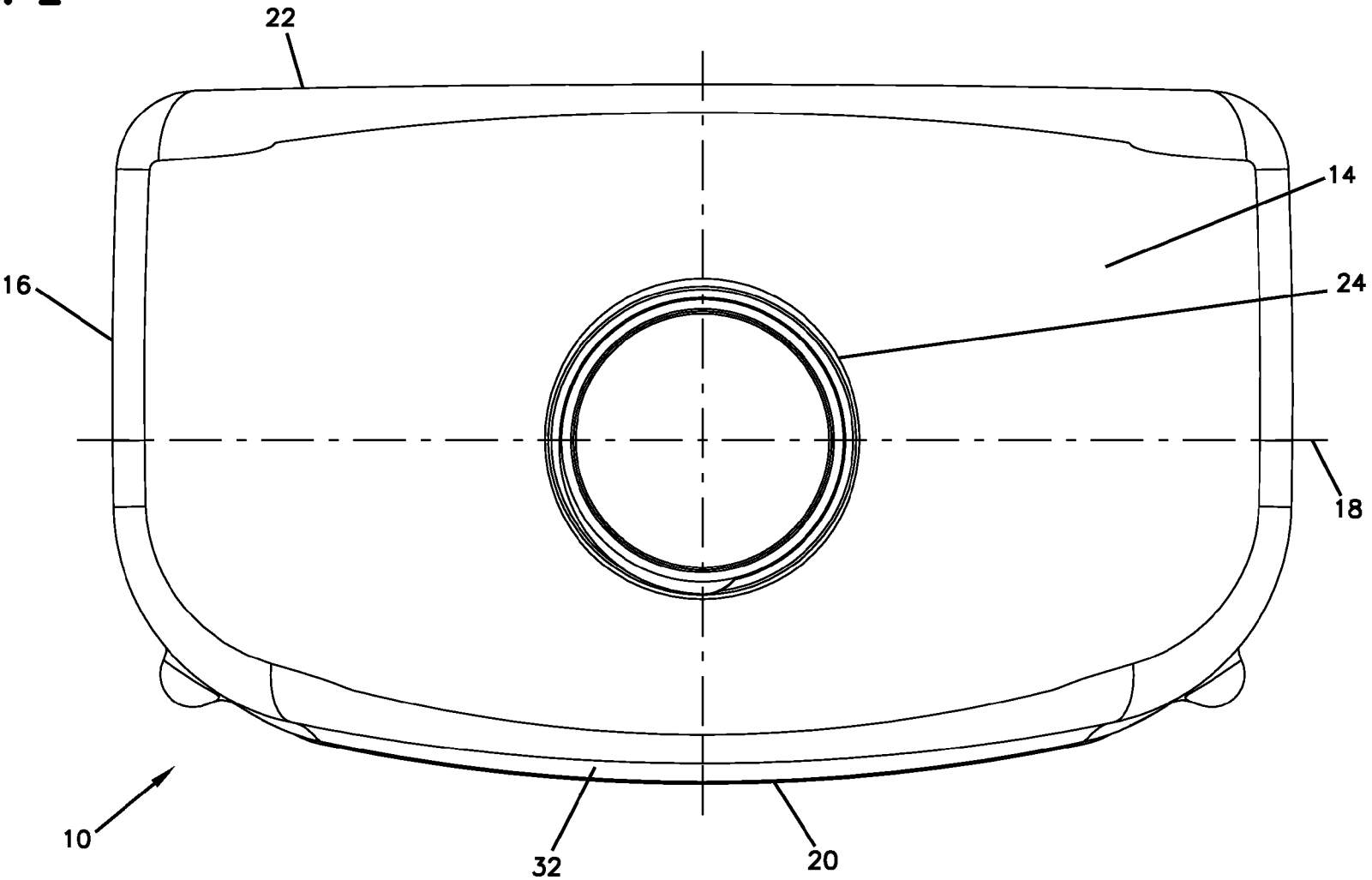
FIG. 2 shows a top view of a bottle with a threaded opening.
Figure 3:
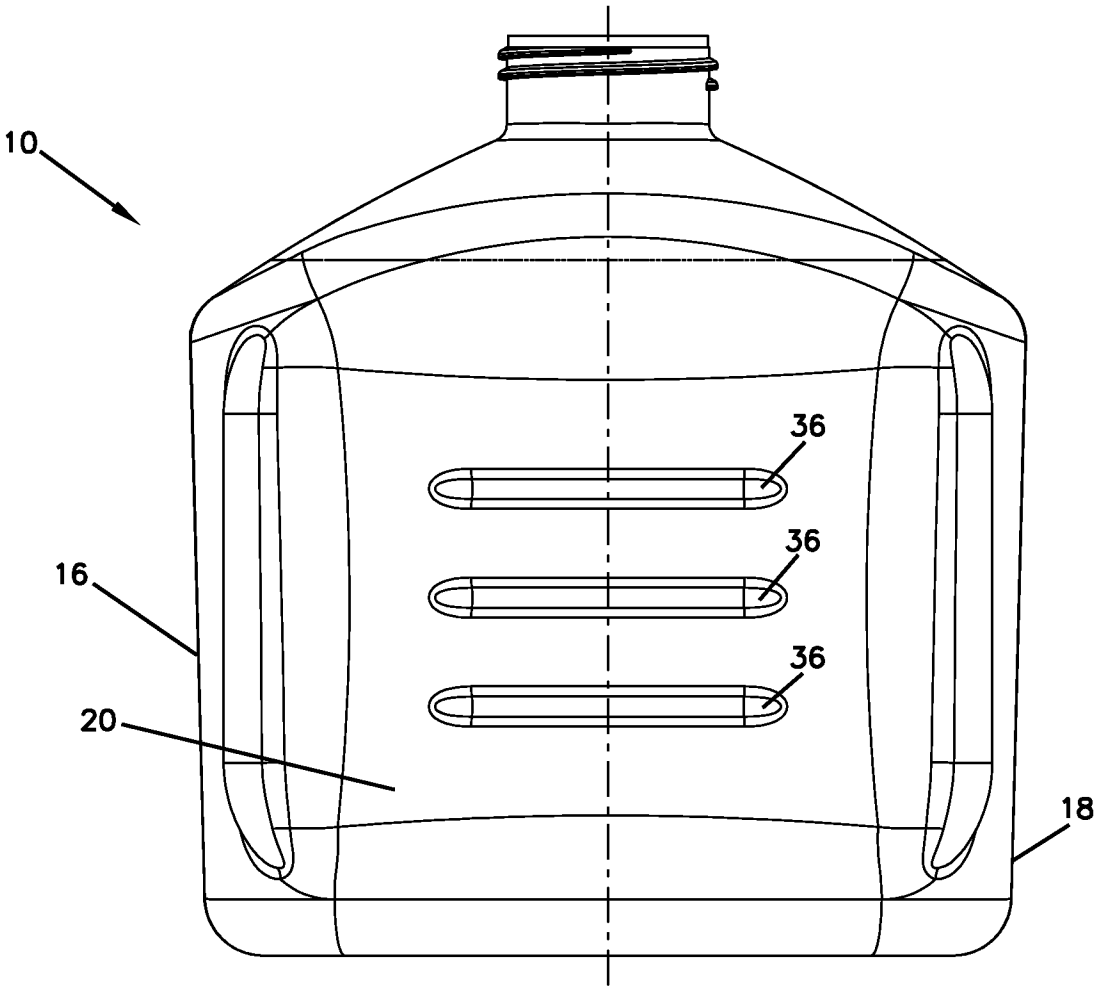
FIG. 3 shows a front view of a bottle with slots on the front panel.
Figure 4:
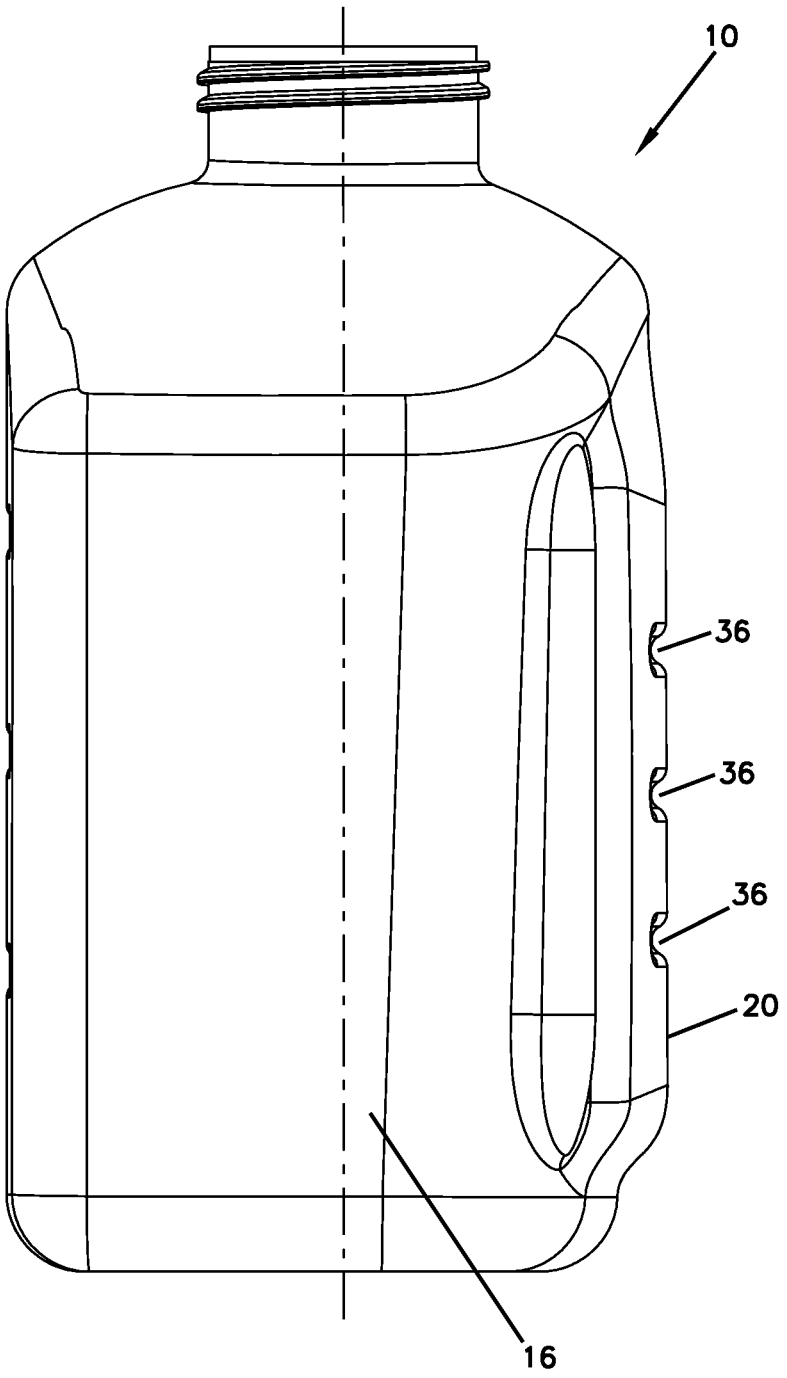
FIG. 4 shows a right-side view of a bottle.
Figure 5:
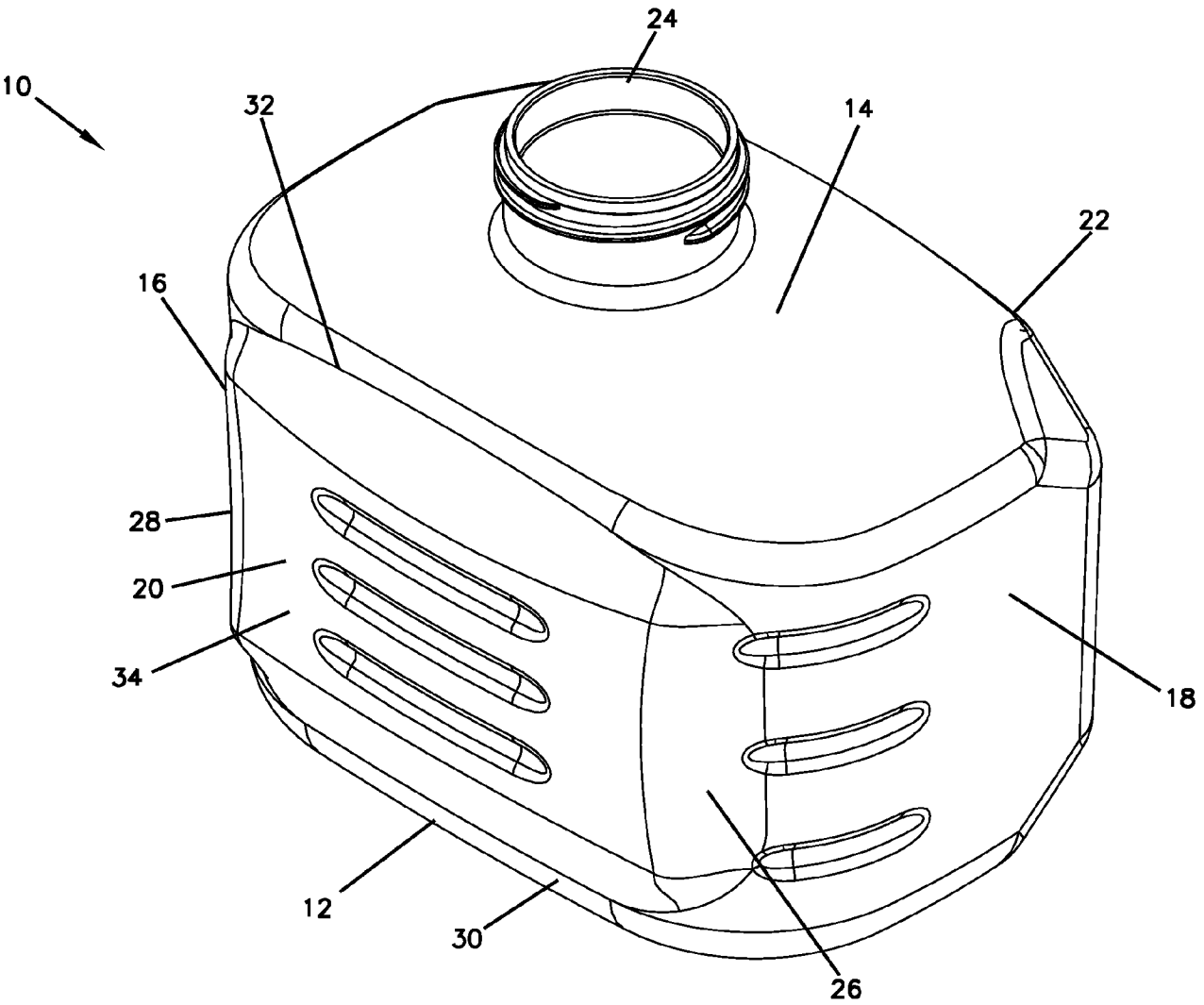
FIG. 5 shows an embodiment of the bottle design with slots on the front, side, and rear panels.
Figure 6:
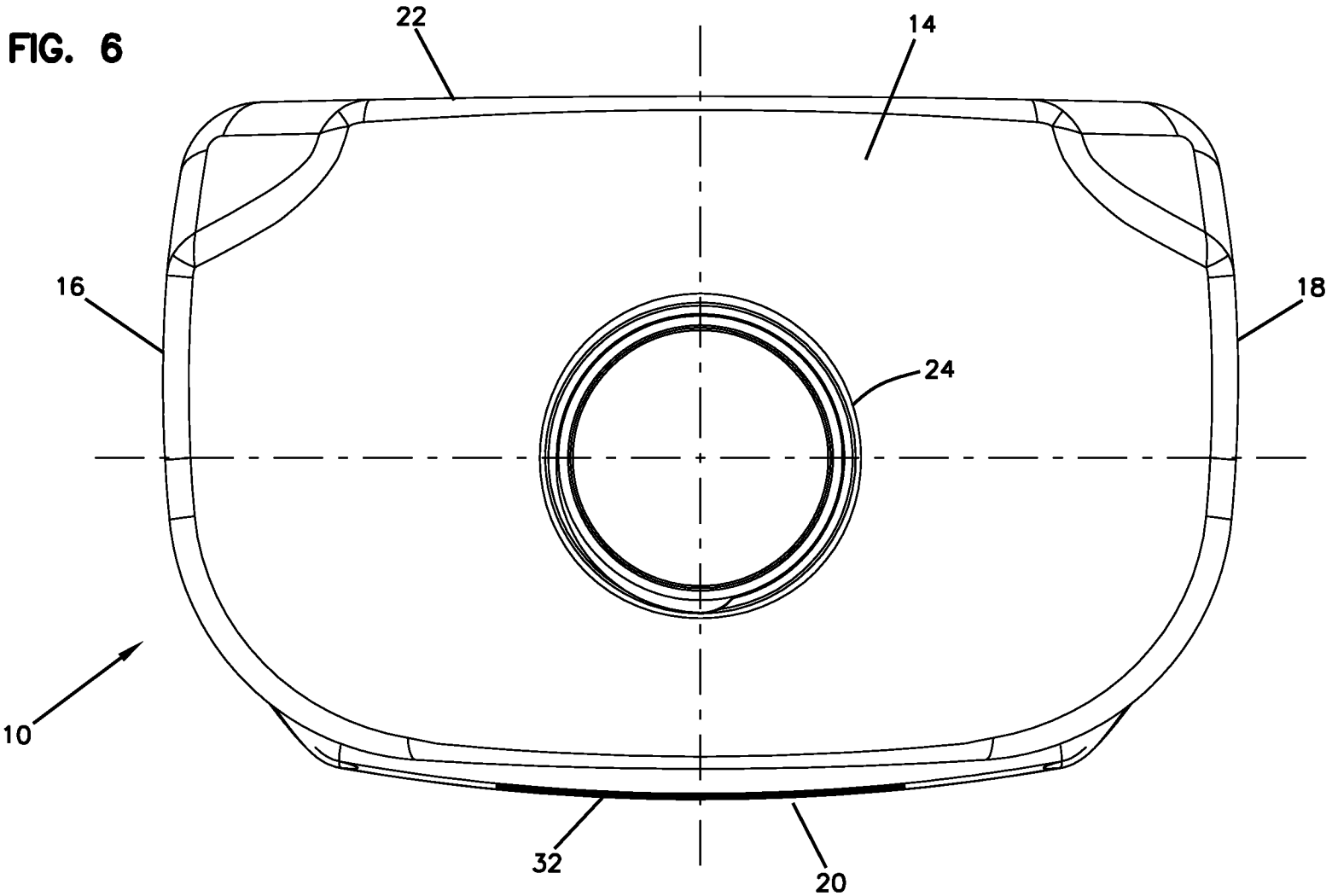
FIG. 6 shows a top view of a bottle with a threaded opening.

Referring now to the Figures, FIG. 1 and FIG. 5 show the bottle body 10 generally. The body 10 includes a base panel 12, an outlet end panel 14, two side panels 16 and 18, a front panel 20, and a rear panel 22. The base panel 12 is generally flat or concave to improve ease of shipping and storage of the bottles in an upright position. The outlet panel 14 is angled towards an integrally molded outlet 24 so as to facilitate draining. This is also shown in FIG. 2 and FIG. 6. In certain embodiments, the outlet 24 may be threaded and the outlet end panel 14 may include additional structure to support the bottle in an upside down position during draining. The side panels 16 and 18 are substantially planar, as is the rear panel 22. The front panel 20 includes curved, faceted surfaces 26, 28, 30, and 32 where it connects to the side panels 16 and 18, outlet end panel 14, and base panel 12. The curved, faceted surfaces 26, 28, 30, and 32 substantially surround a square, flat, centrally located surface 34 of the front panel 20. This surface 34 may be recessed relative to the curved surfaces or may protrude relative to the curved surfaces. The various panels optionally interface with adjacent panels at curved interfaces, although the curved surfaces of the front panel 26, 28, 30, and 32 are of a significantly larger radius than the other interfaces.

The basic geometry described above allows the bottle to fit within a box-style dispenser and collapse in a controlled manner. Due to the geometry, materials used, and other structural elements described below, bottles designed in accordance with the present disclosure will collapse in a known manner, thus limiting the amount of contents that may be wasted due to inaccessibility caused by free collapsing. Further, bottles designed in accordance with the present disclosure will collapse within its defined area, meaning that it will collapse inward, on itself and not outward in a way that exerts force on the interior of a dispenser or other container that it may be placed in.

Figure 7:
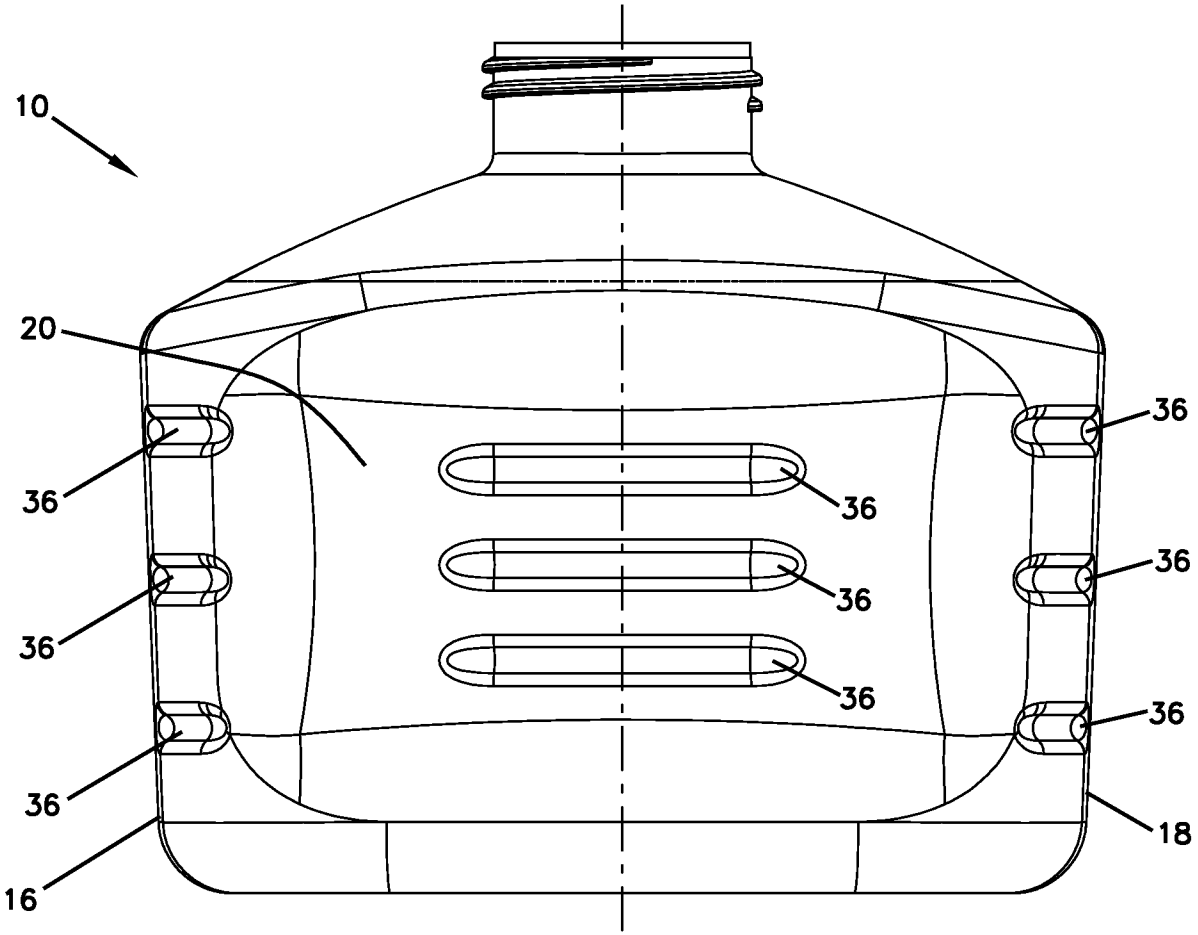
FIG. 7 shows a front view of the bottle with slots on the front and side panels.
Figure 8:
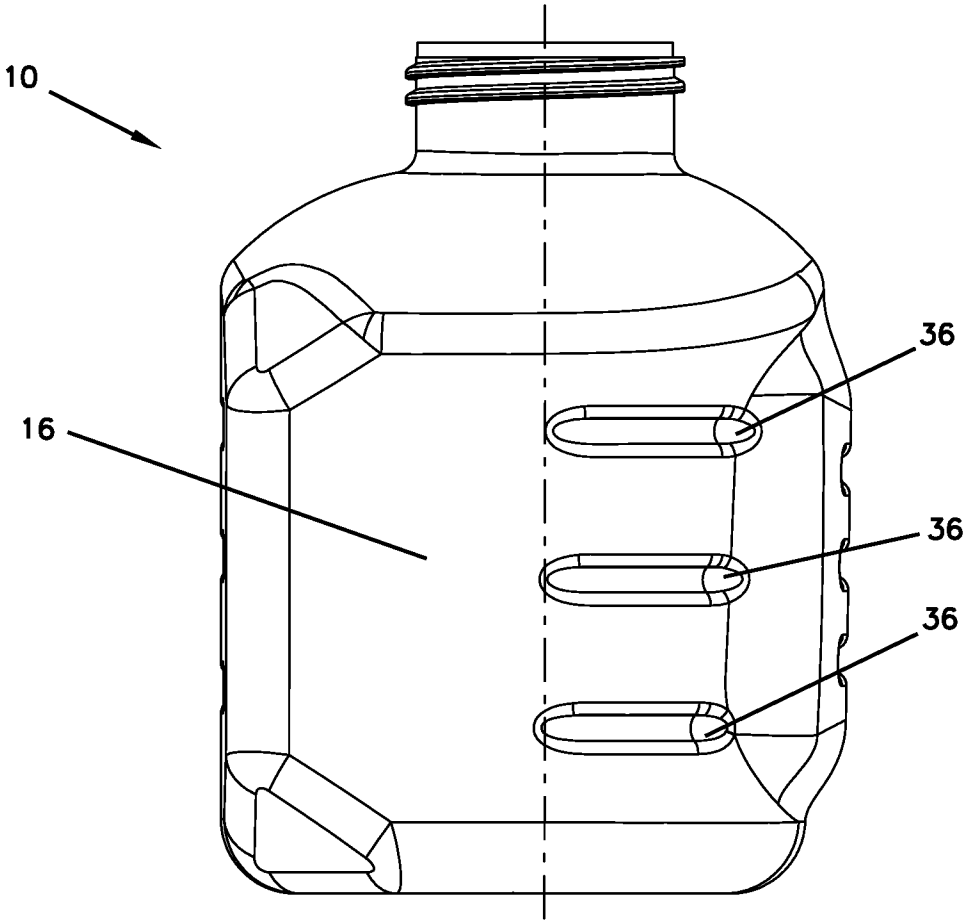
FIG. 8 shows a right-side view of the bottle with slots on the side panel.
Figure 9:
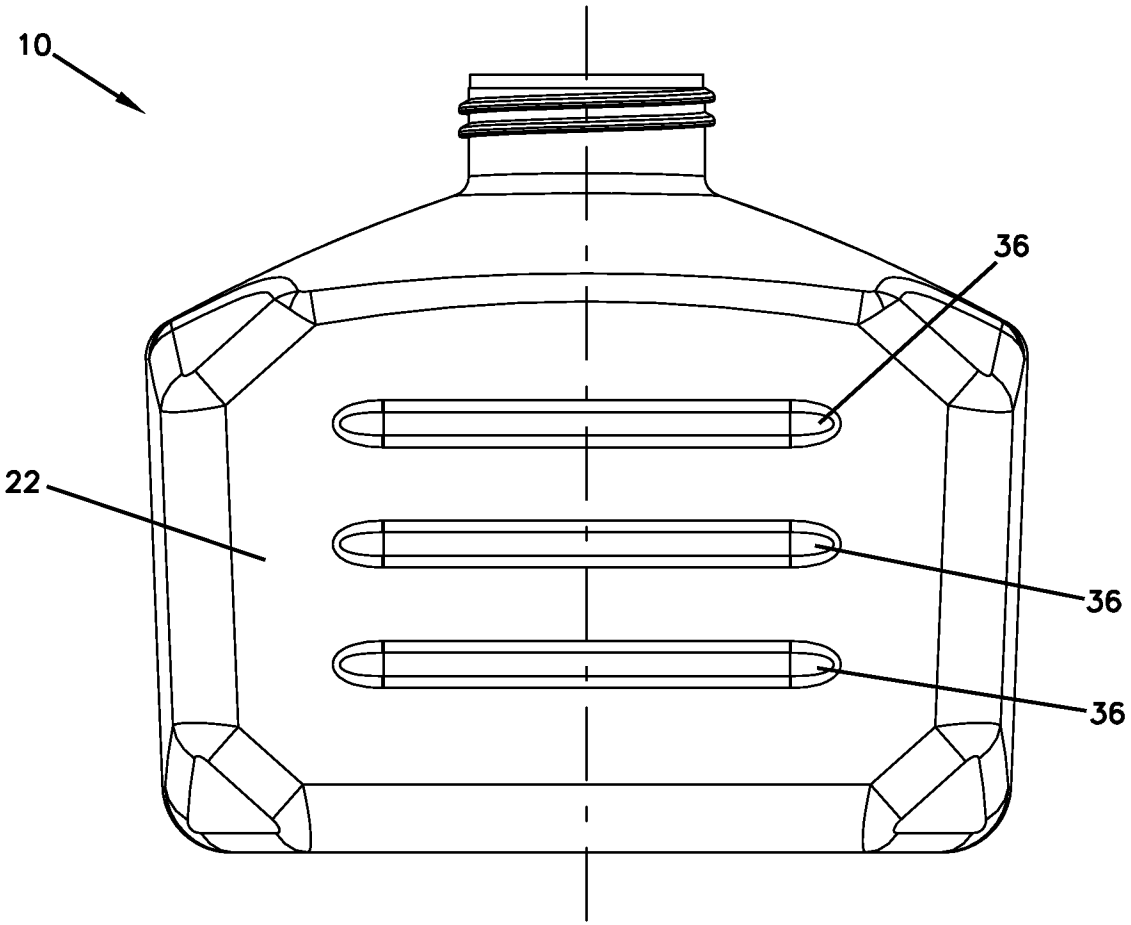
FIG. 9 shows a rear view of the bottle with slots on the rear panel.

FIG. 3, FIG. 4, FIG. 7, FIG. 8, and FIG. 9 show one or more slots, channels, or ribs 36 that are defined by the front 20, and optionally rear 22, and side panels 16 and 18. In the embodiments shown in FIG. 3 and FIG. 7, three slots 36 are formed on the flat surface 34 of the front panel 20. FIG. 9 also shows three optional slots 36 on the rear panel 22. FIG. 7 and FIG. 8 show three more slots 36 on each of the side panels 16 and 18 onto the curved surfaces of the front panel 20. The slots 36 located on the side panels 16 and 18 are optional and help create an off-center fold on the side. In that regard, as the bottle collapses, the portions of the side panels that do not define the slots collapse to a greater degree than the slotted portions. While the slots 36 on the real panel 22 and the side panels 16 and 18 are optional, they are beneficial, especially in smaller sized bottles.

Certain portions of the molded body 10 have greater thicknesses than other portions. For example, the interface 30 of the front panel 20 and the base panel 12 is less thick than the thickness of the outlet end panel 14. As the bottle is drained or otherwise evacuated, the thinner portions of the bottle will collapse to a greater degree than the thicker portions. In that case, a controlled deformation of the bottle may be achieved. The differences in thickness may vary, but in certain embodiments, thicker portions of the bottle may be about two times, about five times, or about ten times greater than the thickness of the thin portions of the bottle.

When the bottle is in an expanded condition, it is able to hold a maximum volume of fluid within its interior chamber. As the contents are drained therefrom, the bottle collapses and the volume of the interior chamber reduces, until the bottle has reached a collapsed condition. In one embodiment, the collapsed condition may be defined as the condition when the minimum volume of the interior chamber is reached. This minimum volume may be less than about 20% of the maximum volume, less than about 15% of the maximum volume, less than about 10% of the maximum volume, less than about 5% of the maximum volume, or less than about 1% of the maximum volume. In some embodiments, the bottle design is such that a vacuum pressure of about 0 to negative 1 bar is sufficient to collapse the bottle.

The bottle may be manufactured in any volume required or desired, although bottles having volumes of about 350 ml, about 550 ml, about 750 ml, and about 1250 ml may be particularly useful. Such bottles may be inserted into rigid box-style dispensers and are supported at the outlet (that is, the bottles are inverted during use, such that the base panel is oriented upward). The rigid box helps prevent the bottle from free collapsing, and also improves aesthetics and deters theft of or tampering with the bottle.

The bottle may be designed to contain a variety of products including food, beverage, cosmetics, soap, shampoo and other hair care products, laundry detergent, bleach, fabric softener, cleaning products like hard surface cleaner, window cleaner, floor cleaner, warewashing detergent, rinse aid, and vehicle care detergent, handcare or skin care products like surgical scrub, lotion, hand sanitizer, and the like. In some embodiments, the product may be a water thin liquid, may be a thickened liquid, a gel, a lotion, or other viscosity. In a preferred embodiment, the product is a handcare or skincare product such as a soap, lotion, surgical scrub, or hand sanitizer that may be a thin liquid, thickened liquid, lotion, or gel.

EXAMPLES

Example 1

A test was conducted to quantify the residual product left in the bottle after the bottle was collapsed. This test included various products attached to foaming pumps, liquid pumps, and alcohol foam pumps. During the test, the bottle was attached to an autonomous air driven actuator triggered by a timer and dispensed at a certain rate. For high viscosity products, the pump was actuated once every three minutes and 20 seconds until the pump began to sputter. Upon sputter, the bottle weight was recorded and the residual product percentage was calculated. For low viscosity products, the pump was actuated every second until the pump began to sputter. Upon sputter, the bottle weight was recorded and the residual product percentage was calculated.

The test used various products with different viscosities two bottles: a 750 ml bottle with the design shown in FIG. 5 and a 1250 ml bottle with the design shown in FIG. 1.

The results from the 750 ml bottle test are shown in Table 1. The results from the 1250 ml bottle test are shown in Table 2.

TABLE 1

| Product | Viscocity Ranges (Centipoise) | Average percent Remaining by Volume |
|---|---|---|
| Liquid Hand Soap | 1000-90,000 | 1.31 |
| Lotion | 22,000-46,000 | 4.26 |
| Foam | 0-500 | 0.43 |
| Foam | 0-500 | 0.74 |
| Alcohol Gel | 1000-90,000 | 2.63 |
| Alcohol Gel | 1000-90,000 | 5.37 |
| Alcohol Gel | 1000-90,000 | 0.63 |
| Alcohol Gel | 1000-90,000 | 6.33 |

TABLE 2

| Product | Viscocity Range (Centipoise) | Average percent Remaining by Volume |
|---|---|---|
| Liquid Hand Soap | 1000-90,000 | 1.07 |
| Foam | 0-500 | 0.22 |
| Foam | 0-500 | 0.30 |
| Alcohol Gel | 1000-90,000 | 1.06 |
| Alcohol Gel | 1000-90,000 | 1.33 |
| Alcohol Gel | 1000-90,000 | 0.21 |

The results show that in all cases, less than 10% of the product remained in the bottle after the bottle was considered collapsed. In most cases, less than 5% of the product remained in the bottle after the bottle was considered collapsed. And in many cases, less than 1% of the product remained in the bottle after the bottle was considered collapsed.

The above specification, examples and data provide a complete description of the manufacture and use of the disclosed bottle. Since many embodiments of the disclosure can be made without departing from the spirit and scope of the invention, the invention resides in the claims.

What is claimed is:

1. A collapsible bottle comprising:

a unitary molded body comprising a plurality of panels defining an interior chamber, wherein the plurality of panels comprise:

an outlet end panel;

a base comprising a base panel oriented in a plane and located on a side of the body opposite the outlet end panel;

two sides, each side comprising a planar side panel, the planar side panels disposed opposite of one another, the side panels connecting the outlet end panel and the base panel, wherein at least one planar side panel at least partially defines a side channel having a length and a width, wherein the length is greater than the width, and wherein the length of the side channel is oriented parallel to the plane of the base panel;

a rear comprising a planar rear panel connected to each of the outlet end panel, the base panel, and the two planar side panels;

a front consisting of a front panel opposite the planar rear panel, the front panel connecting to each of the outlet end panel, the base panel, and the two planar side panels, wherein the front panel consists essentially of a continuous center surface and a plurality of connecting surfaces disposed on each side of the continuous center surface, wherein the plurality of connecting surfaces connect the continuous center surface to the outlet end panel, the base panel, and the two planar side panels, wherein the continuous center surface is substantially surrounded by the plurality of connecting surfaces, and wherein the center surface optionally comprises one or more front channels having a length and a width, wherein the length is greater than the width, and wherein the length of the front channel is oriented parallel to a plane of the base panel; and an outlet protruding externally from the outlet end panel and integrally formed with the outlet end panel so as to provide access to the interior chamber, wherein a connection interface of the base panel and the front panel defines a first thickness and wherein the outlet end panel defines a second thickness, and wherein the second thickness is about two times to about ten times greater than the first thickness.

2. The collapsible bottle of claim 1, wherein the center surface of the front panel defines a square or rectangular shape and wherein the center surface of the front panel protrudes outward relative to the plurality of connecting surfaces.

3. The collapsible bottle of claim 1, wherein the side channel is at least partially defined by both the at least one planar side panel and at least one connecting surface.

4. The collapsible bottle of claim 1, wherein the at least one planar side panel at least partially defines a plurality of side channels.

5. The collapsible bottle of claim 4, wherein each of the side panels partially defines a plurality of side channels and wherein the side channels at each side panel create an off-center fold on the side panel as the bottle collapses.

6. The collapsible bottle of claim 1, wherein the molded body comprises plastic.

7. The collapsible bottle of claim 1, wherein the bottle comprises an expanded condition and a collapsed condition, wherein when in the expanded condition, the interior chamber comprises a maximum volume and wherein when in the collapsed condition, the interior chamber comprises a minimum volume, and wherein the minimum volume comprises no more than about 20 percent of the maximum volume.

8. The collapsible bottle of claim 7, wherein the minimum volume comprises no more than about 10 percent of the maximum volume.

9. The collapsible bottle of claim 7, wherein the minimum volume is obtained by subjecting the interior chamber to a vacuum pressure of about 0 to −1 bar for about 0.05 seconds.

10. The collapsible bottle of claim 1, wherein the front panel defines one or more slots oriented parallel to the plane of the base panel.

* * * * *